US006936100B2

(12) United States Patent
Tadakuma

(10) Patent No.: US 6,936,100 B2
(45) Date of Patent: Aug. 30, 2005

(54) METHOD OF PRODUCING A CRYSTALLINE ITO DISPERSED SOLUTION

(75) Inventor: Yoshio Tadakuma, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 42 days.

(21) Appl. No.: 10/669,658

(22) Filed: Sep. 25, 2003

(65) Prior Publication Data

US 2004/0118332 A1 Jun. 24, 2004

(30) Foreign Application Priority Data

Sep. 30, 2002 (JP) ..... 2002-285871

(51) Int. Cl.[7] ..... C30B 21/02; C30B 28/06
(52) U.S. Cl. ..... 117/68; 117/2; 252/79.2
(58) Field of Search ..... 117/2, 68, 3; 216/87; 252/79.2

(56) References Cited

U.S. PATENT DOCUMENTS 5,271,797 A * 12/1993 Kamisawa ..... 216/87

FOREIGN PATENT DOCUMENTS

| | | |
|---|---|---|
| JP | 5-86605 B | 12/1993 |
| JP | 2679008 | 8/1997 |

* cited by examiner

*Primary Examiner*—Felisa Hiteshew
(74) *Attorney, Agent, or Firm*—Sughrue Mion, PLLC

(57) ABSTRACT

A method of producing a crystalline ITO dispersed solution, which contains the steps of: (a) causing an aqueous mixed solution of an indium compound and a tin compound to react with an aqueous basic solution, thereby generating a gel; (b) removing water content from the gel by solvent-exchange, and dispersing the resultant into an organic solvent; and (c) subjecting the resultant dispersed product to heating treatment.

5 Claims, No Drawings

METHOD OF PRODUCING A CRYSTALLINE ITO DISPERSED SOLUTION

FIELD OF THE INVENTION

The present invention relates to a method of producing a crystalline ITO (indium tin oxide) dispersed solution. The crystalline ITO dispersed solution obtained by the present invention can be used in a transparent electrically conductive film used as an electrode, an antistatic film, an electromagnetic wave blocking film or some other film in a touch panel, a liquid crystal display element, a plasma display element, an electroluminescent element, or the like; or can be used in a ceramic material field or other fields.

BACKGROUND OF THE INVENTION

In recent years, for example, a liquid crystal display device and an electroluminescent display have widely been used as displays. In these displays, transparent electrodes are used in their display element and driving circuit section. For transparent electrically conductive films for the transparent electrodes, ITO, which has a low resistance and a good transparency, is suitable. As the method for forming a thin film of ITO, there is known a method of evaporating ITO on a substrate by sputtering, vapor-deposition or ion beam deposition. Since this method needs an expensive device such as a vacuum device, costs for producing ITO thin films rise. Furthermore, the size of a thin film which can be produced is limited and large-area deposition cannot be attained since the thin film is produced in vacuum.

In order to solve the above-mentioned problems, a film-forming method based on coating with a coating solution has been investigated as another method for forming ITO thin films. This method has advantages that the size of substrates is not limited and no especial film-forming machine is required. Thus, this method is an industrially promising method.

The coating method is roughly classified into two methods, that is, a method of coating a substrate with an ITO precursor dispersed solution, and drying and firing (calcinating) the substrate to form an ITO film, and a method of dispersing crystalline or amorphous ITO into a solvent, coating a substrate with the dispersed solution and then drying the substrate to form an ITO film. In the latter, the method includes a firing step as needed, so as to make it possible to lower the resistivity or improve the mechanical strength of the film.

As the ITO precursor, there is frequently used a gel obtained by hydrolyzing a mixed solution of an indium compound and a tin compound.

The indium compound and the tin compound may be alkoxides, halides, inorganic acid salts, organic acid salts, and other compounds thereof. These compounds, together with a complexing agent if necessary, are dissolved in a suitable solvent, and then water is added to the solution so as to hydrolyze the solution, to give a gel. The gel is made of an amorphous hydroxide. In order to make this gel into an ITO thin film made of a crystalline indium/tin composite oxide, it is essential to apply and dry the gel and then subject the dried gel to a firing step at not less than a temperature of 200 to 300° C. The thus-obtained ITO generally has a large (coarse) particle size which is uneven. Thus, the ITO does not fall easily in an even film state. Problems remain in the case that the ITO is applied in particular to fields in which evenness and fineness are required. Since the hydroxide which is an ITO precursor releases water molecules in the firing step, the volume thereof decreases. This volume decrease causes strain in the thin film and the film becomes cracked. Thus, problems such that the thickness of the thin film cannot be made large are caused.

As the crystalline ITO dispersed solution whose volume decrease is small when the solution is applied and fired, there is known an ink wherein ITO fine particles prepared by a physicochemical high-temperature process are dispersed in an organic resin and a solvent. However, ITO fine particles as prepared by such a method in general make secondary aggregates; therefore, the smoothness of the surface of a thin film formed by applying and firing the ITO fine particles is unsatisfactory. This causes haze and other problems, so that the light transmissivity lowers.

As the method for preparing a crystalline metal oxide in a solution, there is known a method of hydrolyzing a metal compound and then subjecting the resultant to hydrothermal treatment in an autoclave. JP-B-5-86605 (pages 2 to 5 and Tables 1 to 4, "JP-B" means examined Japanese patent publication) discloses a method of adding an aqueous ammonium bicarbonate solution to a mixed solution of tin tetrachloride and antimony trichloride to generate a coprecipitation gel of Sb and Sn, and subjecting the gel to hydrothermal treatment, thereby preparing a crystalline tin/antimony oxide sol. In this method, all of the preparing steps are performed in aqueous solution. Even if tin tetrachloride and indium trichloride are used and attempted to prepare ITO by the same method, the resultant is a mixed hydroxide of indium and tin.

A great number of examples wherein a metal alkoxide is used as the above-mentioned metal compound are reported. Even in the case that such an alcohol/water mixed solvent is used and the alcohol content by percentage is very high, a product obtained by heating treatment using an autoclave varies dependently on the kind of the metal. In the case of using indium alkoxide and tin alkoxide, the resultant product is a mixed hydroxide of indium and tin.

Japanese Patent No. 2679008 (pages 2 to 4 and FIG. 1) discloses a method of dispersing a mixed hydroxide of indium and tin in an organic solvent in a colloidal state, subjecting the dispersed solution to azeotropic distillation, and drying/firing the resultant, thereby producing ITO powder. However, this method is different from and cannot be applied to the present invention, which is to produce a crystalline ITO dispersed solution.

SUMMARY OF THE INVENTION

The present invention resides in a method of producing a crystalline ITO dispersed solution, which comprises the steps of:

(a) causing an aqueous mixed solution of an indium compound and a tin compound to react with an aqueous basic solution, thereby generating a gel;

(b) removing water content from the gel by solvent-exchange, and dispersing the resultant into an organic solvent; and (c) subjecting the resultant dispersed product to heating treatment.

Other and further features and advantages of the invention will appear more fully from the following description.

DETAILED DESCRIPTION OF THE INVENTION

According to the present invention, there is provided the following means:

(1) A method of producing a crystalline ITO dispersed solution, comprising the steps of:

(a) causing an aqueous mixed solution of an indium compound and a tin compound to react with an aqueous basic solution, thereby generating a gel;

(b) removing water content from the gel by solvent-exchange, and dispersing the resultant into an organic solvent; and (c) subjecting the resultant dispersed product to heating treatment.

(2) The method according to the item (1), wherein an alcohol is used as the organic solvent in the step (b).

(3) The method according to the item (1) or (2), wherein the heating treatment is conducted at 150 to 300° C. in the step (c).

(4) The method according to the item (1) or (2), wherein the heating treatment is conducted at high temperature and high pressure in the step (c).

(5) The method according to any one of the items (1) to (4), wherein the average particle size of ITO nanoparticles in the resultant dispersed solution is from 1 to 20 nm.

As a result of eager investigation, the inventors have found out that the above-mentioned problems in the prior techniques can be solved by heating an indium/tin mixed hydroxide gel in an organic solvent. Thus, the present invention has been made.

The method of producing a crystalline ITO dispersed solution of the present invention will be described in more detail hereinafter.

The average particle size of fine particles in the ITO dispersed solution obtained by the present invention is generally from 1 to 20 nm, preferably from 1 to 10 nm, and the fine particles are preferably monodispersive particles. In the monodispersive particles referred to in the present invention, the variation coefficient of the particle size distribution thereof is preferably 30% or less, more preferably 20% or less, and further preferably 10% or less. The concentration of the ITO particles in the crystalline ITO dispersed solution obtained by the present invention is preferably from 1 to 20% by mass, more preferably from 5 to 10% by mass.

In the present invention, an aqueous basic solution is first caused to react with an aqueous mixed solution of an indium compound and a tin compound, to yield a gel. Examples of the indium compound which can be used in the present invention include indium trichloride and hydrates thereof; and examples of the tin compound which can be used in the present invention include tin tetrachloride, tin tetrasulfate and hydrates thereof. Examples of the aqueous basic solution include aqueous solutions of hydroxides or bicarbonates of alkali metals (such as potassium and sodium), and bases such as ammonium bicarbonate. However, in the present invention, they are not limited to these examples.

About the chemicals at the time of gel-producing reaction, the aqueous mixed solution of the indium compound and the tin compound is dropwise added to the aqueous basic solution while the basic solution is vigorously stirred. If the dropping speed is too fast, the viscosity of the gel becomes high so that the rotation speed of solution-rotation by the stirring lowers. As a result, only a gel having an uneven composition can be obtained. Thus, the dropping speed is preferably 20 ml/minute or less, more preferably 5 ml/minute or less. The temperature at the time of the gel-producing reaction may be room temperature. Thus, heating and cooling operations are unnecessary. The reaction time is not particularly limited, and is generally from 0.5 to 2 hours.

The blended mole ratio of the tin compound to the indium compound (i.e., the mole ratio of Sn/In) is preferably adjusted to be 0.3 or less. If the mole ratio of Sn/Ti is too large, crystalline ITO cannot be easily obtained as a single compound of composite oxides. As a result, a gel having an uneven composition may be generated. The blended mole ratio of Sn/In is preferably 0.05 or more from the viewpoint of the performance of ITO.

The amount to be used of the base is not particularly limited. Preferably, the base is used in an amount which makes the pH of the solution be 6 or more when the gel-producing reaction ends.

Unnecessary salts in the thus-prepared gel are generally removed by a desalting method such as centrifugation, electrodialysis or ultrafiltration. It is preferred that the amount of remaining impurities is small from the viewpoint of the production or use of crystalline ITO. However, only when ammonium bicarbonate is used to produce the gel, it is allowable only that ammonia remains in the gel.

An organic solvent is then added to the gel after being desalted (or washed), and the resultant is heated, thereby being subjected to solvent-exchange. The solvent exchange is conducted by heating the gel sufficiently and thus vaporizing water, which has a lower boiling point. In this case, the pressure of the system may be reduced in order to accelerate the vaporization of the water content. By this treatment, the gel can be made into sol having no water content.

The heating can be performed by using an oil bath, a mantle heater, microwaves or the like. In order to remove the water content efficiently, it is preferred to set the temperature so as to reach the highest boiling point of the mixed solvents. The time required for the solvent-exchange is not particularly limited, and may be a time sufficient for removing the water content.

By adding acetic acid to the reaction system at the time of the solvent exchange, the sol can be made stable. The addition amount of acetic acid is preferably from 0.5 to 10 times, more preferably from 1 to 3 times the mole number of metals contained in the sol.

The kind of the organic solvent is not particularly limited. Alcohols are preferable. Alcohols having a boiling point of 120° C. or more are preferable. Examples of the preferable alcohols include 2-methoxyethanol, 2-ethoxyethanol, cyclohexanol, α-terpineol, and 2-phenoxyethanol. 2-Ethoxyethanol and cyclohexanol are particularly preferable. These alcohols may be used alone or in combination of two or more thereof.

The sol dispersed in the alcohol by the solvent exchange is appropriately adjusted about the concentration thereof, and then the solution is subjected to heating treatment. The heating treatment referred to herein means that after the water content is removed in the solvent exchange, for some time the solution is continuously heated as it is, or that the solution is transferred to a container such as an autoclave and the solution is treated at high temperature and high pressure (the pressure being appropriately decided dependently on the solvent to be used and the heating temperature). In the case of the former, it is effective that the heating treatment is conducted to the solution in an alcohol having a boiling point of 150° C. or more, for example, 2-phenoxyethanol. On the other hand, in the case of the latter, it is effective that the heating treatment is conducted to the solution in an alcohol having a boiling point of less than 150° C., for example, 2-ethoxyethanol. If the metal concentration in the solution is made too high in the case of the latter, precipitation is generated during the heating treatment at high temperature and high pressure; therefore, the metal concentration in the solution is preferably 5% or less, more preferably 2% or less by mass. In this case, the metal concentration in the solution can finally be adjusted by concentrating the solution by ultrafiltration, a rotary evaporator, or the like after the heating treatment.

If the temperature of the heating treatment is too low, no crystallization is caused. If the temperature is too high, the aggregation of the particles is accelerated to generate precipitation. Thus, the temperature is preferably from 150 to 300° C., more preferably from 180 to 250° C. The heating treatment time is not particularly limited, and is generally from 1 to 10 hours.

The crystalline ITO dispersed solution obtained by the method of the present invention is preferably a dispersed solution containing particles wherein Sn and In are dissolved in a solid state, the particles having an Sn/In ratio of 0.3 or less and a particle size of 20 nm. Thus, the ITO solution is very useful for transparent electrically conductive material.

The ITO dispersed solution can be used, for example, as transparent electrically conductive material, in an electrode, an antistatic film, an electromagnetic wave blocking film or some other film in a touch panel, a liquid crystal display element, a plasma display element, an electroluminescent element, or the like.

According to the present invention, it is possible to prepare a stable crystalline ITO dispersed solution which cannot be prepared by any conventional metal oxide producing method.

The present invention will be more specifically described by way of the following examples. The materials, amounts to be used, ratios, treatment contents, handling steps, and others described in the following examples can be appropriately modified as far as they do not depart from the spirit and scope of the present invention. Accordingly, the scope of the present invention should not be restrictedly interpreted by the following specific examples.

EXAMPLES

Example 1

Into 100 ml of water was dissolved 23.3 g of anhydrous indium trichloride, to prepare an aqueous indium trichloride solution. To this aqueous solution was added 4.1 g of tin tetrachloride pentahydrate, and this salt was dissolved to prepare a mixed solution of indium chloride and tin chloride (Solution A). Into 344 ml of water was dissolved 45.3 g of ammonium bicarbonate, to prepare an aqueous ammonium bicarbonate solution (Solution B). The total amount of the Solution A was gradually added to the Solution B at room temperature over 1 hour with stirring. After the completion of addition, the mixed solution was continuously stirred for another 1 hour. The thus-obtained coprecipitation gel of indium and tin was repeatedly purified by ultrafiltration so that the electric conductivity thereof would be 10 $\mu$S/cm or less. In this way, 100 ml of a gel was yielded (Solution C). Into a glass three-neck flask was put 10 ml of the Solution C stirred homogeneously, and then thereto were added 120 ml of 2-ethoxyethanol, 120 ml of cyclohexanol and 6 ml of acetic acid. While the solution was sufficiently stirred, the solution was heated in an oil bath to distill off water and ethoxyethanol. After the solution was cooled, cyclohexanol was further added thereto so that the total volume would be 80 ml. Thereafter, an autoclave was used to subject the solution to heating treatment at 200° C. for 30 minutes. The resultant dispersed solution was yellowish transparent solution. After this was dried and the dried product was observed with XRD (X-ray diffraction), a broad diffraction pattern was found which was identified as crystalline indium oxide-type ITO. No diffraction peak originating from the tin compound was found. According to TEM (transmission electron microscope) observation, the ITO particles had an average particle size of 3.8 nm, and were monodispersive (variation coefficient: 18%). Furthermore, this dispersed solution was allowed to stand still at ambient temperature for 2 months. As a result, no precipitation was observed and the dispersive state was being maintained.

Comparative Example 1

A dispersed solution was produced in the same manner as in Example 1, except that no heating treatment with an autoclave was conducted. The thus-obtained dispersed solution was XRD-observed, but no diffraction peak was found. The dispersed solution was analyzed by ESCA (electron spectroscopy for chemical analysis). As a result, the product therein was a composite hydroxide of tin and indium.

Comparative Example 2

Water was added to 10 ml of a fraction sampled from the Solution C, prepared in Example 1, with sufficiently stirring, so as to set the total volume to 80 ml. Thereafter, an autoclave was used to subject the resultant solution to heating treatment at 200° C. for 30 minutes. The thus-obtained suspension was dried and XRD-observed, so that a sharp diffraction pattern was found, which was identified as indium hydroxide.

Example 2

Into a glass three-neck flask was put 10 ml of a fraction sampled from the Solution C, prepared in Example 1, while the Solution C was sufficiently stirred, and further thereto were added 120 ml of 2-ethoxyethanol, 120 ml of 2-phenoxyethanol and 6 ml of acetic acid. While the solution was sufficiently stirred, the solution was heated in an oil bath to distill off water content and ethoxyethanol. Then, in the state that the temperature of the solution was kept at 200° C., the solution was stirred under normal pressure for 2 hours to continue reaction. The resultant transparent solution was dried and XRD-observed, so that a broad diffraction pattern was found, which was identified as crystalline indium oxide-type ITO. No diffraction peak originating from the tin compound was found. According to TEM observation, the ITO particles had an average particle size of 3.5 nm, and were monodispersive (variation coefficient: 19%). Furthermore, this dispersed solution was allowed to stand still at ambient temperature for 2 months. As a result, no precipitation was observed and the dispersive state was being maintained.

XRD diffraction peaks and the results of the ESCA analysis of the particles generated dependently on the difference in the dispersed solution preparing methods are collectively shown in Table 1.

TABLE 1

| Sample | Solvent in heating step | Temperature at heating step | Peak by XRD | ESCA |
|---|---|---|---|---|
| Example 1 | Cyclohexanol | Autoclave at 200° C. | Indium oxide type | Oxide |
| Comparative Example 1 | No heating step | — | No peak | Hydroxide |
| Comparative Example 2 | Water | Autoclave at 200° C. | Indium hydroxide | Hydroxide |
| Example 2 | 2-Phenoxy ethanol | Heating at normal pressure at 200° C. | Indium oxide type | Oxide |

Test Example 1

The concentration of ITO in the crystalline ITO dispersed solution prepared in Example 1 was adjusted to be 10% by mass. From this dispersed solution, 0.2 ml of a fraction was sampled, and then dropped and applied onto a glass substrate of 25-mm square to obtain a thin film by spin coating. In the spin coating, the rotation number of the substrate was 1500 rpm and the rotation thereof was continued for 20 seconds. Thereafter, the coated substrate was dried at 150° C. for 30 minutes. The surface state and the light transmissivity at a wavelength of 550 nm were observed. The applied amount of the thus-obtained ITO thin film was 0.81 g/m$^2$ in terms of metal In. The surface state and the light transmissivity of the thin film are together shown in Table 2.

Test Example 2

The concentration of indium/tin hydroxide in the amorphous indium/tin hydroxide dispersed solution prepared in Comparative Example 1 was adjusted to be 10% by mass. From this dispersed solution, 0.2 ml of a fraction was sampled, and then dropped and applied onto a glass substrate of 25-mm square to obtain a thin film by spin coating. In the spin coating, the rotation number of the substrate was 1500 rpm and the rotation thereof was continued for 20 seconds. Thereafter, the coated substrate was dried at 150° C. for 30 minutes. The surface state and the light transmissivity at a wavelength of 550 nm were observed. The applied amount of the thus-obtained ITO thin film was 0.79 $g/m^2$ in terms of metal In, and was substantially the same as the thin film obtained in Example 3. The surface state and the light transmissivity of the thin film are together shown in Table 2.

TABLE 2

| Sample | Surface state after the film was dried | Light transmissivity (550 nm) |
|---|---|---|
| Test Example 1 | No crack was observed | 97% |
| Test Example 2 | A large number of cracks were observed | 65% |

Having described our invention as related to the present embodiments, it is our intention that the invention not be limited by any of the details of the description, unless otherwise specified, but rather be construed broadly within its spirit and scope as set out in the accompanying claims.

What is claimed is:

1. A method of producing a crystalline ITO dispersed solution, comprising the steps of:

(a) causing an aqueous mixed solution of an indium compound and a tin compound to react with an aqueous basic solution, thereby generating a gel;

(b) removing a water content from the gel by solvent-exchange, and dispersing a resultant into an organic solvent; and (c) subjecting the resultant dispersed product to heating treatment.

2. The method according to claim 1, wherein an alcohol is used as the organic solvent in the step (b).

3. The method according to claim 1, wherein the heating treatment is conducted at 150 to 300° C. in the step (c).

4. The method according to claim 1, wherein the heating treatment is conducted at high temperature and high pressure in the step Cc).

5. The method according to claim 1, wherein the average particle size of ITO nanoparticles in the dispersed solution is from 1 to 20 nm.

* * * * *